US010667049B2

(12) United States Patent
Ozcan et al.

(10) Patent No.: US 10,667,049 B2
(45) Date of Patent: May 26, 2020

(54) DETECTING THE PRESENCE OF WIND NOISE

(71) Applicant: Nokia Technologies Oy, Espoo (FI)

(72) Inventors: Koray Ozcan, Hampshire (GB); Miikka Vilermo, Siuro (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/341,983

(22) PCT Filed: Oct. 3, 2017

(86) PCT No.: PCT/FI2017/050692

§ 371 (c)(1),
(2) Date: Apr. 15, 2019

(87) PCT Pub. No.: WO2018/073489

PCT Pub. Date: Apr. 26, 2018

(65) Prior Publication Data

US 2019/0253795 A1 Aug. 15, 2019

(30) Foreign Application Priority Data

Oct. 21, 2016 (GB) ..... 1617854.3

(51) Int. Cl.
*H04R 3/00* (2006.01)
*H04R 1/10* (2006.01)
*H04R 1/04* (2006.01)

(52) U.S. Cl.
CPC ..... *H04R 3/005* (2013.01); *H04R 1/04* (2013.01); *H04R 1/1083* (2013.01); *H04R 2410/07* (2013.01)

(58) Field of Classification Search
CPC .. H04R 3/005; H04R 1/1083; H04R 2410/05; H04S 2400/15; G10L 21/0208
(Continued)

(56) References Cited

U.S. PATENT DOCUMENTS 4,420,655 A 12/1983 Suzuki
7,340,068 B2 3/2008 Petersen et al.
(Continued)

FOREIGN PATENT DOCUMENTS

EP 1578168 A2 9/2005
EP 1732352 A1 12/2006
(Continued)

OTHER PUBLICATIONS

"Mini Windjammers", Rycote, Retrieved on Mar. 5, 2019, Webpage available at : https://rycote.com/microphone-windshield-shock-mount/mini-windjammers/.
(Continued)

*Primary Examiner* — Alexander Krzystan
(74) *Attorney, Agent, or Firm* — Harrington & Smith

(57) ABSTRACT

A method comprising: receiving a first microphone signal from a first microphone having a first frequency response characteristic (110$_1$, 112$_1$) at frequencies (114) associated with wind noise; receiving a second microphone signal from a second microphone having a second frequency response characteristic (110$_2$, 112$_2$) at frequencies (114) associated with wind noise, wherein the first frequency response characteristic (110$_1$, 112$_1$) provides less gain than the second frequency response characteristic (110$_2$, 112$_2$) over the range of frequencies (114) associated with wind noise; and processing the first microphone signal and the second microphone signal to detect the presence of wind noise.

17 Claims, 3 Drawing Sheets

(58) Field of Classification Search
USPC ..... 381/359, 94.2, 94.9, 94.1
See application file for complete search history.

(56) References Cited

U.S. PATENT DOCUMENTS

| | | | | |
|---|---|---|---|---|
| 7,577,262 | B2 | 8/2009 | Kanamori et al. | |
| 7,885,420 | B2 | 2/2011 | Hetherington et al. | |
| 8,184,816 | B2 | 5/2012 | Ramakrishnan et al. | |
| 8,781,137 | B1 | 7/2014 | Goodwin | |
| 8,873,769 | B2 | 10/2014 | Petersen et al. | |
| 9,313,599 | B2 | 4/2016 | Tammi et al. | |
| 9,456,289 | B2 | 9/2016 | Tammi et al. | |
| 2008/0049953 | A1 | 2/2008 | Harney et al. | |
| 2010/0183167 | A1 | 7/2010 | Phelps et al. | |
| 2010/0280824 | A1 | 11/2010 | Petit et al. | |
| 2011/0268292 | A1* | 11/2011 | Suvanto ..... | H04R 3/005 381/92 |
| 2012/0253798 | A1 | 10/2012 | Walters et al. | |
| 2015/0104048 | A1 | 4/2015 | Uchida et al. | |
| 2015/0213811 | A1* | 7/2015 | Elko ..... | H04R 3/005 381/92 |
| 2016/0155453 | A1 | 6/2016 | Harvey et al. | |

FOREIGN PATENT DOCUMENTS

| | | | |
|---|---|---|---|
| EP | 2871824 | A1 | 5/2015 |
| GB | 2525170 | A | 10/2015 |
| JP | H03139097 | A | 6/1991 |
| WO | 2007/106399 | A2 | 9/2007 |
| WO | 2009/042385 | A1 | 4/2009 |
| WO | 2011/006496 | A1 | 1/2011 |
| WO | 2012/109019 | A1 | 8/2012 |
| WO | 2013/091021 | A1 | 6/2013 |
| WO | 2016/011499 | A1 | 1/2016 |

OTHER PUBLICATIONS

"Micro Windjammer", Rycote, Retrieved on Mar. 5, 2019, Webpage available at : https://rycote.com/microphone-windshield-shock-mount/micro-windjammers/.

"Cyclone", Rycote, Retrieved on Mar. 5, 2019, Webpage available at : https://rycote.com/microphone-windshield-shock-mount/cyclone/.

"GoPro Has Announced the Hero4 Session Camera", iTech Post, Retrieved on Mar. 5, 2019, Webpage available at : http://www.itechpost.com/articles/15075/20150706/gopro-has-announced-the-hero4-session-camera.htm.

"Sennheiser Has a Fix for Bad GoPro Audio", SlashGear, Retrieved on Mar. 5, 2019, Webpage available at : https://www.slashgear.com/sennheiser-has-a-fix-for-bad-gopro-audio-14436370/.

Search Report received for corresponding United Kingdom Application No. 16178543, dated Nov. 29, 2016, 4 pages.

International Search Report and Written Opinion received for corresponding Patent Cooperation Treaty Application No. PCT/FI2017/050692, dated Feb. 21, 2018, 18 pages.

* cited by examiner

DETECTING THE PRESENCE OF WIND NOISE

RELATED APPLICATION

This application was originally filed as PCT Application No. PCT/FI2017/050692 filed Oct. 3, 2017 which claims priority benefit from GB Application No. 1617854.3 filed Oct. 21, 2016.

TECHNOLOGICAL FIELD

Embodiments of the present invention relate to detecting the presence of wind noise.

BACKGROUND

Wind noise arises from an airflow at or near a microphone which causes pressure variations detected as sound waves. In some examples, the wind may be a naturally generated wind that varies randomly. In other examples, the wind may be a constant air flow that varies relative to a microphone as the environment of the microphone changes, for example, as a device housing the microphone is rotated or moved.

Wind noise can wholly or partially obscure target audio which is desired to be captured by a microphone.

It is therefore desirable to identify when wind noise may be present so that it might be prevented or suppressed.

BRIEF SUMMARY

According to various, but not necessarily all, embodiments of the invention there is provided a method comprising: receiving a first microphone signal from a first microphone having a first frequency response characteristic at frequencies associated with wind noise; receiving a second microphone signal from a second microphone having a second frequency response characteristic at frequencies associated with wind noise, wherein the first frequency response characteristic provides less gain than the second frequency response characteristic over the range of frequencies associated with wind noise; and processing the first microphone signal and the second microphone signal to detect the presence of wind noise.

According to various, but not necessarily all, embodiments of the invention there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
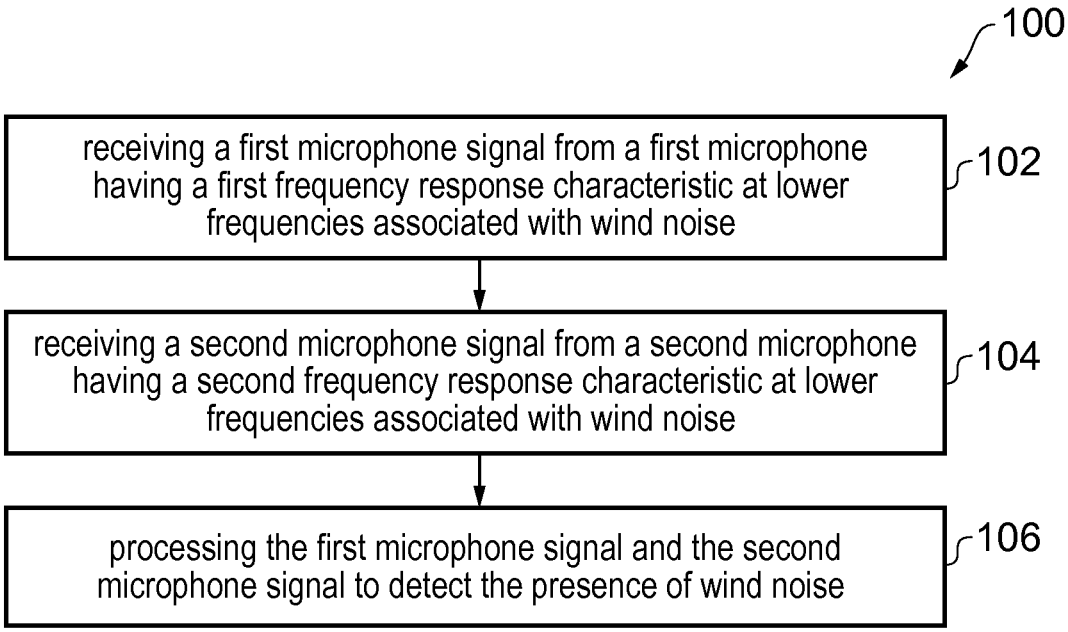
FIG. 1 illustrates an example of a method for detecting the presence of wind noise.

Figures, and in particular FIG. 1, illustrate an example of a method 100 for detecting the presence of wind noise. Wind noise arises from an air flow at or near a microphone which causes pressure variations detected as sound waves. In some examples, the wind may be a naturally generated wind that varies randomly. In other examples, the wind may be a constant air flow that varies relative to a microphone as the environment of the microphone changes, for example, as a device housing the microphone is rotated or moved.

At block 102, the method 100 comprises receiving a first microphone signal $\mathbf{202}_1$ from a first microphone $\mathbf{200}_1$ having a first frequency response characteristic $\mathbf{110}_1$ at frequencies 114 associated with wind noise.

At block 104, the method 100 comprises receiving a second microphone signal $\mathbf{202}_2$ from a second microphone $\mathbf{200}_2$ having a second frequency response characteristic $\mathbf{110}_2$ at frequencies 114 associated with wind noise, wherein the first frequency response characteristic $\mathbf{110}_1$ provides less gain than the second frequency response characteristic $\mathbf{110}_2$ over the range of frequencies 114 associated with wind noise.

At block 106, the method 100 comprises processing the first microphone signal $\mathbf{202}_1$ and the second microphone signal $\mathbf{202}_2$ to detect the presence of wind noise.

The method 100 may, in some examples, comprise additional blocks and sub-blocks not illustrated.

Figure 2:
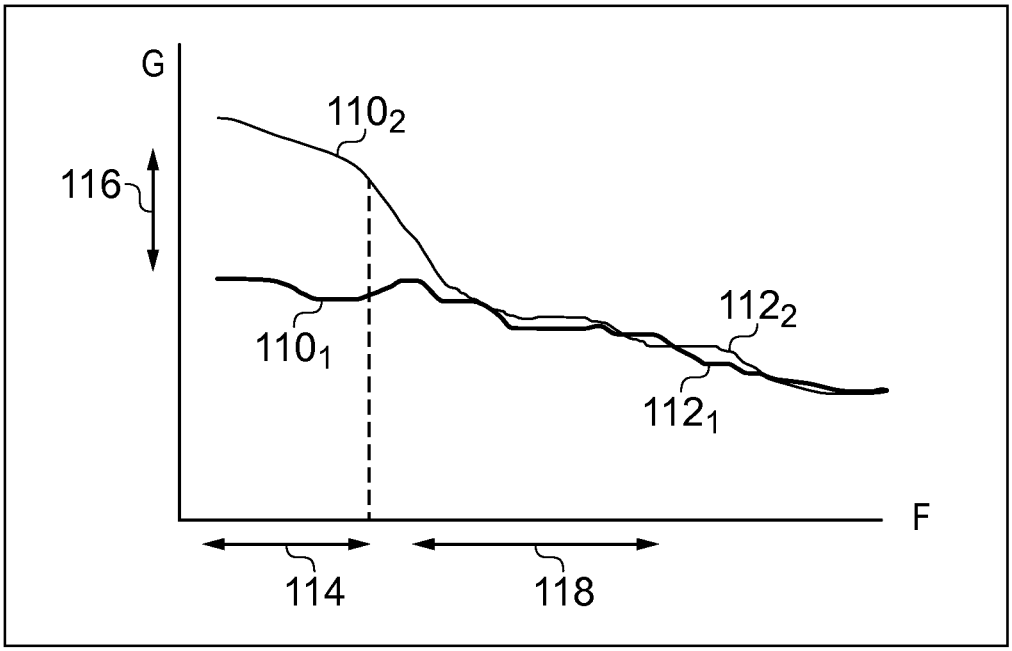
FIG. 2 illustrates an example of frequency response characteristics for the microphones of the apparatus.

FIG. 2 illustrates example frequency response characteristics 112 for the microphones 200 of an apparatus 10. A frequency response characteristic is a measure of frequency dependent gain of a microphone. The gain is plotted as the 'y-axis' and frequency plotted as the 'x-axis'.

A frequency response characteristic $\mathbf{112}_1$ for first microphone $\mathbf{200}_1$ and a second frequency response characteristic $\mathbf{112}_2$ for second microphone $\mathbf{200}_2$ are plotted in this example.

The frequencies 114 associated with wind noise are illustrated in the figure. The frequencies 114 associated with wind noise are in this example, but not necessarily all examples, lower frequencies. These lower frequencies 114 may, for example, be less than 200 Hz or less than 100 Hz. In other examples, the frequencies 114 associated with wind noise are additionally or alternatively mid-range frequencies.

The frequencies 114 associated with wind noise may vary with the severity of the wind noise and may, for example, depend upon relative wind speed.

The frequencies 114 associated with wind noise may be controlled via mechanical design of the microphone and the microphone environment.

The frequencies 114 associated with wind noise may therefore be tuned to a be a predetermined one or more frequencies which may, or may not be at lower frequencies.

A first frequency response characteristic $\mathbf{110}_1$ at frequencies 114 associated with wind noise is labelled. This is that portion of the frequency response characteristic $\mathbf{112}_1$ for the first microphone $\mathbf{200}_1$ over the range of frequencies 114 associated with wind noise.

A second frequency response characteristic $\mathbf{110}_2$ at frequencies 114 associated with wind noise is labelled. This is that portion of the frequency response characteristic $\mathbf{112}_2$ for the second microphone $\mathbf{200}_2$ over the range of frequencies 114 associated with wind noise.

The first frequency response characteristic $\mathbf{110}_1$ provides less gain than the second frequency response characteristic $\mathbf{112}_2$ over the range of frequencies 114 associated with wind noise. The difference in gain between the first frequency response characteristic $110_1$ and the second frequency response characteristic $112_2$ over the range of frequencies 114 associated with wind noise, is labeled as gain difference 116 in the figure.

The gain difference may be defined as the second frequency response characteristic $112_2$ minus the first frequency response characteristic $110_1$ over the range of frequencies 114. It may, for example be the minimum difference or an average difference such as the mean difference. The different attenuation (gain difference 118) arising from the difference between the first frequency response characteristic $110_1$ and the second frequency response characteristic $110_2$ at frequencies 114 associated with wind noise is in this example greater than 6 dB.

The higher frequencies 118 associated with human speech are illustrated in FIG. 2. These higher frequencies 118 may, for example, be between 400 Hz-4 kHz.

The frequency response 110 of the first microphone $200_1$ compared to the second microphone $200_2$ is significantly less at frequencies 114 associated with wind noise than at higher frequencies 118 associated with speech.

In the example illustrated in FIG. 2, but not necessarily all examples, the difference between the frequency response 110 of the first microphone $200_1$ compared to the second microphone $200_2$ is much greater at the lower frequencies 114 associated with wind noise than at higher frequencies 118 associated with speech. In the illustrated example, the frequency response 110 of the first microphone $200_1$ remains within a range of relatively low gain across the lower frequencies 114 and the higher frequencies 118 whereas the frequency response 110 of the second microphone $200_2$ is higher across the lower frequencies 114 and falls to a lower value, more similar to that of the frequency response 110 of the first microphone $200_1$ before the higher frequencies 118. The difference in gain between the frequency response $110_1$ of the first microphone $200_1$ and the frequency response $110_2$ of the second microphone $200_2$ is therefore large at the lower frequencies 114 and much smaller at the higher frequencies 118.

In other examples, the profiles of the frequency response 110 of the first microphone $200_1$ and the second microphone $200_2$ may be different. For example, a difference in gain between the frequency response $110_1$ of the first microphone $200_1$ and the frequency response $110_2$ of the second microphone $200_2$ may extend to different frequencies 114 and into and possibly beyond the higher frequencies 118.

Figure 3:
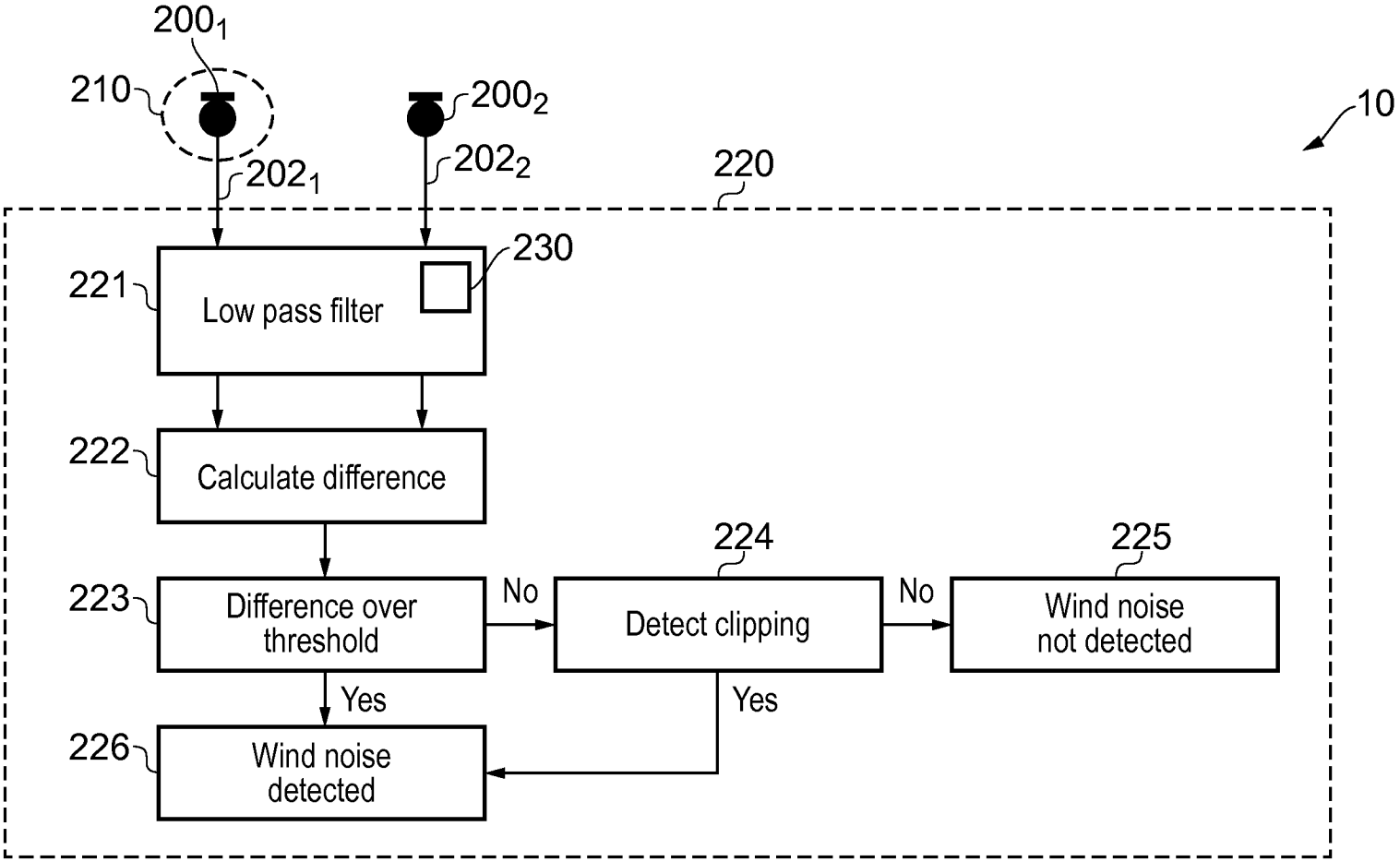
FIG. 3 illustrates an example of an apparatus.

The method 100 may be performed by any suitable apparatus 10. One example of an apparatus 10 is described with respect to FIG. 3.

The apparatus 10 described comprises a plurality of microphones 200 including at least a first microphone $200_1$ and a second microphone $200_2$. A microphone 200 is any suitable audio transducing means that transduces an incident audio signal to an electrical signal.

The first microphone $200_1$ has a first frequency response characteristic $110_1$ at frequencies 114 associated with wind noise and produces a first microphone signal $202_1$. The second microphone $200_2$ has a second frequency response characteristic $110_2$ at frequencies 114 associated with wind noise and produces a second microphone signal $202_2$.

The first frequency response characteristic $110_1$ provides less gain than the second frequency response characteristic $110_2$ over the range of frequencies 114 associated with wind noise, for example as illustrated in FIG. 2.

The apparatus 10 described also comprises processing circuitry 220 configured to at least process the first microphone signal $202_1$ and the second microphone signal $202_2$.

The processing circuitry 220 may be configured to perform the method 100. The processing circuitry may be any suitable processing means.

The apparatus 10 therefore comprises: a first microphone $200_1$ having a first frequency response characteristic $110_1$ at frequencies 114 associated with wind noise; a second microphone $200_2$ having a second frequency response characteristic $110_2$ at frequencies 114 associated with wind noise, wherein the first frequency response characteristic $110_1$ provides less gain than the second frequency response characteristic $110_2$ over the range of frequencies 114 associated with wind noise; and processing circuitry 220 configured to process a first microphone signal $202_1$ from the first microphone $200_1$ and a second microphone signal $202_2$ from the second microphone $200_2$ to detect the presence of wind noise.

In this example the first microphone $200_1$ is wind-suppressed to provide a desired first frequency response characteristic $110_1$ at the frequencies 114 associated with wind noise.

In this example the second microphone $200_2$ has less wind-suppression, for example is not wind-suppressed, to provide a desired second frequency response characteristic $110_2$ at the frequencies 114 associated with wind noise.

A difference in mechanical design between the first microphone $200_1$ and the second microphone $200_2$ causes the differences between the first frequency response characteristic $110_1$ and the second frequency response characteristic $110_2$ at the frequencies 114 associated with wind noise. The mechanical design deliberately introduces a differential response to wind noise. For example, the mechanical design may introduce a frequency-dependent attenuator 210 that reduces the frequency response of the first microphone $200_1$ at frequencies 114 associated with wind noise.

In this example, the first microphone $200_1$ comprises a low frequency attenuator 210 that reduces the frequency response of the first microphone $200_1$ at lower frequencies 114 associated with wind noise. In this example, the second microphone $200_2$ does not comprise a low frequency attenuator 210. Where multiple microphones 200 are used only the first microphone $200_1$ would, in this example, comprise a low frequency attenuator 210 and the other microphones 200 would not.

Examples of suitable attenuators include but are not limited to a microphone cover with apertures, a foam rubber cover, a windscreen, or artificial fur.

The method 100 is performed by processing circuitry 220 at blocks 221-226.

The processing circuitry 220 processes the first microphone signal $202_1$ and the second microphone signal $202_2$ to detect the presence of wind noise.

The block 106 of the method 100, in this example, comprises comparing the first microphone signal $202_1$ and the second microphone signal $202_2$ only at frequencies 114 associated with wind noise, to detect the presence of wind noise.

At block 221, the first microphone signal $202_1$ is pass filtered and the second microphone signal $202_2$-pass filtered before being compared to detect the presence of wind noise.

The term 'pass filtering' refers to frequency selective filtering. The filter passes certain frequencies and rejects (attenuates) other frequencies. A pass band filter is one type of pass filter than passes frequencies within a certain band (range) and rejects frequencies outside that range. A low pass filter is one type of pass filter that passes frequencies with a frequency lower than a cut-off frequency. The pass filtering may be performed using a low-pass filter in some examples. The pass filtering may be performed using a band-pass filter in some examples.

One or more pass filters 320 may be used. The pass filter 320 may be a fixed-pass filter that has constant characteristics or may be a variable-pass filter than has variable characteristics such as a variable cutoff frequency and/or frequency response. The-pass filtering may be performed in the analogue domain or the digital domain.

Next at blocks 223-224 the processing circuitry 220 processes the (limited frequency) first microphone signal $\mathbf{202}_1$ and the (limited frequency) second microphone signal $\mathbf{202}_2$ to detect the presence of wind noise. The (limited frequency) first microphone signal $\mathbf{202}_1$ and the (limited frequency) second microphone signal $\mathbf{202}_2$ are compared to detect the presence of wind noise.

At block 223, the processing circuitry 220 compares the (limited frequency) first microphone signal $\mathbf{202}_1$ and the (limited frequency) second microphone signal $\mathbf{202}_2$ to detect the presence of wind noise by comparing the (limited frequency) first microphone signal $\mathbf{202}_1$ against the (limited frequency) second microphone signal $\mathbf{202}_2$ to detect the presence of wind noise. However, there are a large number of other methods for comparing two different microphone signals.

In this example, if wind noise is detected the method 100 moves to block 226 in the method performed by processing circuitry 220 and if wind noise is not detected the method 100 moves to block 224 in the method performed by processing circuitry 220. That is blocks 223, 224 are sequential. However, in other examples they may be parallel or in reverse sequential order.

At block 224, which is optional, the processing circuitry 220 compares the (limited frequency) first microphone signal $\mathbf{202}_1$ and the (limited frequency) second microphone signal $\mathbf{202}_2$ to detect the presence of wind noise by comparing the (limited frequency) first microphone signal $\mathbf{202}_1$ against a reference and the (limited frequency) second microphone signal $\mathbf{202}_2$ against a reference to detect the presence of wind noise. This approach can be used to detect when both the (limited frequency) first microphone signal $\mathbf{202}_1$ and the (limited frequency) second microphone signal $\mathbf{202}_2$ are clipped because of very high wind noise.

In this example, if wind noise is detected, the method 100 moves to block 226 in the method performed by the processing circuitry 220 and if wind noise is not detected the method 100 moves to block 225 in the method performed by the processing circuitry 220.

Where a comparison is performed using the (limited frequency) first microphone signal $\mathbf{202}_1$ and the (limited frequency) second microphone signal $\mathbf{202}_2$ for example in block 223, 224, the comparison may use an instantaneous or average amplitude value or may use an instantaneous or average amplitude squared value. The average amplitude squared value represents energy. The comparisons may, for example, comprise comparing energy of the (limited frequency) first microphone signal $\mathbf{202}_1$ and energy of the (limited frequency) second microphone signal $\mathbf{202}_2$ to detect the presence of wind noise. The average may be performed over a limited number N of cycles (N>1), for example, an average over 4 cycles at 100 Hz is equivalent to an average over 0.04 seconds (40 ms).

Where the comparison at block 223 comprises comparing energy of the (limited frequency) first microphone signal $\mathbf{202}_1$ against the energy of the (limited frequency) second microphone signal $\mathbf{202}_2$ to detect the presence of wind noise, the presence of wind noise may be detected where the energy of the (limited frequency) second microphone signal $\mathbf{202}_2$ exceeds the (limited frequency) first microphone signal $\mathbf{202}_1$ by more than a threshold value, for example 6 dB.

In some but not necessarily all examples, conditioning of the (limited frequency) first microphone signal $\mathbf{202}_1$ and the (limited frequency) second microphone signal $\mathbf{202}_2$ may occur before comparison at blocks 223, 224. In some circumstances it may be desirable to perform a relative normalization (equalization) between the (limited frequency) first microphone signal $\mathbf{202}_1$ and the (limited frequency) second microphone signal $\mathbf{202}_2$ before comparison. This may for example comprises adjusting the (limited frequency) first microphone signal $\mathbf{202}_1$ and/or the (limited frequency) second microphone signal $\mathbf{202}_2$ in dependence upon a comparison between the first microphone signal $\mathbf{202}_1$ and the second microphone signal $\mathbf{202}_2$ at a higher range of frequencies not associated with wind noise e.g. adjusted (limited frequency) first microphone signal $\mathbf{202}_1$ (limited frequency) first microphone signal $\mathbf{202}_1$*((higher frequency) second microphone signal $\mathbf{202}_2$/(higher frequency) first microphone signal $\mathbf{202}_1$.

In some but not necessarily all examples, the microphones 200 may have the same directional response. For example, the first microphone $\mathbf{200}_1$ and the second microphone $\mathbf{200}_2$ may have the same directionality.

Figure 4:
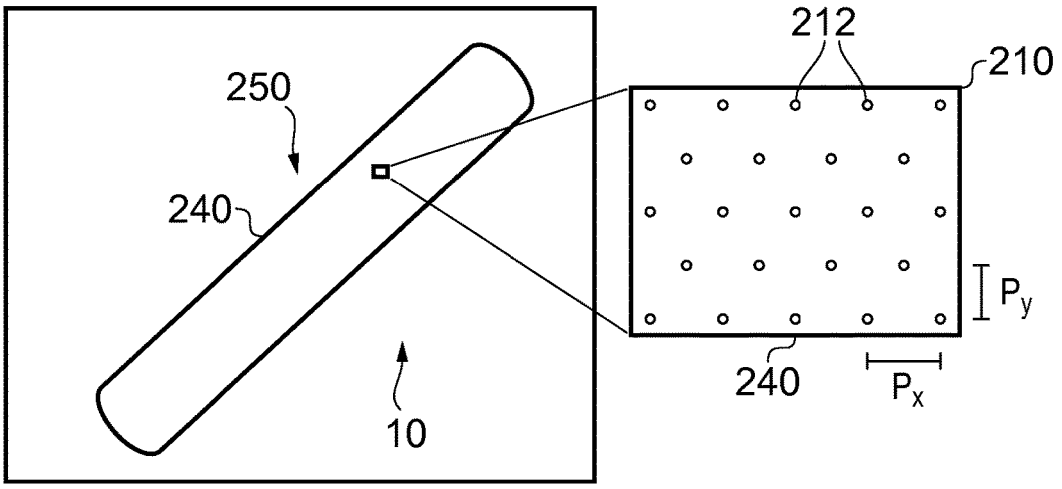
FIG. 4 illustrates an example of an electronic device.

In the example illustrated in FIG. 4 the first microphone $\mathbf{200}_1$ comprises a cover 240 that operates as an attenuator 210. In this example the microphones 200 (the first microphone $\mathbf{200}_1$ and the second microphone $\mathbf{200}_2$) are integrated within an electronic device 250. An end portion 251 of the electronic device 250 is illustrated in FIG. 4. The end portion 251 comprises a cover 240 that forms a low frequency attenuator 210 for the first microphone $\mathbf{200}_1$.

As illustrated in the zoomed-in portion of the cover 240 to the right of FIG. 4, the cover 240 comprises multiple apertures 212 (through holes) that provide, in combination, an audio pathway to the first microphone $\mathbf{200}_1$ inside the device 240 from outside the device 240.

In this example the multiple apertures 212 are arranged to be invisible to a human eye in normal viewing conditions (distance e.g. >0.1 m and illumination e.g. <1000 lux). For the multiple apertures 212 to be invisible at 10 cm to normal adult human with visual acuity 1 MAR, the diameter of each aperture 212 may be smaller than 30 μm or 50 μm.

In this example, the first microphone $\mathbf{200}_1$ has a tuned first frequency response characteristic $\mathbf{110}_1$ at the band of frequencies 114 associated with wind noise by controlling one or more of: the diameter of each aperture 212, the pitch $p_x$, $p_y$ between apertures 212, depth of each aperture 212, number of apertures 212, and area of coverage of apertures 212.

The apertures 212 may comprise a hydrophobic or oleophobic surface treatment of the surface of the cover 240 within and/or adjacent the apertures 212. The surface of the cover defining the apertures 212 may additionally or alternatively be treated to increase surface roughness.

A micro-aperture is an aperture of diameter (maximum dimension) less than 100 μm.

In some examples, the apertures or micro-apertures 212 may have the following modifiable parameters:

diameter, which is the diameter (maximum dimension) of each single aperture 212 (assumed constant from one end of the aperture 212 to the other, for simplicity);

pitch $p_x$, which is the distance between the centers of two apertures 212 adjacent in a first direction and/or pitch $p_y$, which is the distance between the centers of two aperture 212 adjacent in a second direction orthogonal to the first direction;

thickness, which is the thickness of the aperture 212, which in the case of straight aperture 212 is also equivalent to the actual length of each hole;

length, which is the path length of the aperture 212, which in the case of straight aperture 212 is also equivalent to the thickness of each hole;

distribution area, which is the size of the area of the cover 240 that is perforated with apertures 212;

pitch/diameter ratio, which is the ratio of pitch to diameter, and is always greater than 1;

total open area, which is the combined area of all aperture 212;

relative open area, which is the ratio of total open area to distribution area.

These parameters are selected to achieve a first frequency response characteristic $\mathbf{110}_1$ that provides less gain than a second frequency response characteristic $\mathbf{110}_2$ over the range of frequencies 114 associated with wind noise.

There may be additional design freedom. For example, visibility of apertures 212 may be reduced by reducing the diameter and having a larger pitch/diameter ratio. For example, for good dust protection, a very small diameter (e.g. 0.05 mm or less) may be used with a reasonably small total open area. For example, for good acoustical performance (i.e. a low enough acoustic impedance), a reasonably large diameter (e.g. 0.2 mm) may be used, with large relative open area, and large enough total open area and small thickness (e.g. 0.5 mm). For example, for avoiding the apertures 212 getting fully clogged by grease, a large porous area, large relative open area, and small thickness may be used. For example, for mechanical strength, a large pitch/diameter ratio and large thickness may be used. For example, for good water protection, a small diameter may be used, with a reasonably small total open area.

Referring back to FIGS. 1 and 3, the method 100 may be extended to include operations that occur after detecting 226 (or not detecting 225) the presence of wind noise.

For example, an output microphone signal may be produced which may be wind-noise suppressed after detecting 226 wind noise and not wind-noise suppressed after not detecting 225 the presence of wind noise. This means that the loss of signal quality arising from wind-noise suppression is selectively applied only when it has an advantage.

As an example, if processing the first microphone signal $\mathbf{202}_1$ and the second microphone signal $\mathbf{202}_2$ detects the presence of wind noise then the method 100 may comprise, for example at block 226, suppressing wind noise on the first microphone signal $\mathbf{202}_1$ and/or second microphone signal $\mathbf{202}_2$ to produce a wind-noise suppressed microphone signal. If processing the first microphone signal $\mathbf{202}_1$ and the second microphone signal $\mathbf{202}_2$ does not detect the presence of wind noise then the method 100 may comprise, for example at block 226, not suppressing wind noise on the first microphone signal $\mathbf{202}_1$ or second microphone signal $\mathbf{202}_2$ to produce an un-suppressed microphone signal from the first microphone signal $\mathbf{202}_1$ and/or second microphone signal $\mathbf{202}_2$.

Wind-noise suppression may for example be achieved by digital processing using a wind suppression algorithm or other processing. As an example, high pass filtering a microphone signal may be used to suppress wind noise. The high-pass filtering may for example use a cut-off frequency at a frequency greater than 100 Hz or 200 Hz. The high-pass filtering may for example use a cut-off frequency at a frequency less than 400 Hz.

A decision may be taken as to which of the microphone signals will be selected for production of an output signal.

The production of a wind-noise suppressed microphone signal may comprise selecting the first microphone signal $\mathbf{202}_1$ and/or the second microphone signal $\mathbf{202}_2$ for suppression of wind noise. The wind-noise suppressed microphone signal may, for example, comprise exclusively the first microphone signal $\mathbf{202}_1$. The wind-noise suppressed microphone signal may, for example, exclude only the first microphone signal $\mathbf{202}_1$.

The production of a wind-noise suppressed microphone signal may comprise selecting the first microphone signal $\mathbf{202}_1$ and the second microphone signal $\mathbf{202}_2$ for wind noise suppression when a first threshold criterion is not satisfied, and selecting the first microphone signal $\mathbf{202}_1$ not the second microphone signal $\mathbf{202}_2$ for use with or without wind noise suppression when a first threshold criterion is satisfied. Thus only the first microphone signal $\mathbf{202}_1$ may be selected for wind noise suppression when a first threshold criterion is satisfied.

A decision may be taken as to if and how the microphone signals will be processed for production of an output signal.

The production of a wind-noise suppressed microphone signal may comprise determining whether or not to apply wind suppression to the first microphone signal $\mathbf{202}_1$.

The production of a wind-noise suppressed microphone signal may comprise selecting the first microphone signal $\mathbf{202}_1$ not the first microphone signal $\mathbf{202}_1$ for wind noise suppression when a second threshold criterion is satisfied, and selecting the first microphone signal $\mathbf{202}_1$ not the second microphone signal $\mathbf{202}_2$ for use without wind noise suppression when the second threshold criterion is not satisfied.

The first criterion threshold may be a lower threshold for strength of wind noise and the second criterion threshold may be a higher threshold for strength of wind noise.

The following scenarios are therefore possible for example:

Use only audio from the first microphone $\mathbf{202}_1$ or microphones 200 with better wind noise suppression Use only audio from the first microphone $\mathbf{202}_1$ or microphones 200 with better wind noise suppression and enable wind noise suppression algorithm from the audio from those microphones 200.

Use audio from all microphones 200, but enable wind noise suppression algorithm for the second microphone $\mathbf{202}_2$ or microphones 200 with less or no wind noise suppression Use audio from all microphones 200, but enable wind noise suppression algorithm for all microphones 200.

Use audio from all microphones 200, but enable wind noise suppression algorithm for all microphones 200 using a stronger wind noise suppression algorithm for the second microphone $\mathbf{202}_2$ and other microphones 200 with less or no wind noise suppression The following scenario is therefore possible for example:

When there is low wind noise (e.g. gain difference 116 <6 dB) then use audio from all microphones 200, but enable a wind noise suppression algorithm for all microphones 200.

When there is medium wind noise (e.g. 6 dB≤gain difference 116 <9 dB) use only audio from the first microphone $\mathbf{202}_1$ or microphones 200 with better wind noise suppression When there is high wind noise (e.g. gain difference 116 ≥9 dB) then use only audio from the first microphone $\mathbf{202}_1$ or microphones 200 with better wind noise suppression and enable a wind noise suppression algorithm for the audio from those microphones.

Referring back to FIGS. 1 and 3, the method 100 may be extended to include operations that occur after detecting 226 (or not detecting) 225 the presence of wind noise.

For example, an output control signal may be produced after detecting wind noise. This may be provided to one or more audio algorithms that require a certain number of microphones and/or a certain microphone at a certain location so that their operation can be adapted.

For example, if processing the first microphone signal $\mathbf{202}_1$ and the second microphone signal $\mathbf{202}_2$ detects the presence of wind noise then the method 100, for example at block 226, provides a control output to one or more audio algorithms that require a certain number of microphones and/or a certain microphone at a certain location so that the operation of the algorithm can be adjusted.

The following scenario is therefore possible for example:

If there is only one microphone available (e.g. because it is not disturbed by wind noise) the processing circuitry 220 may only record or may only enable recording in mono.

If there are only two microphones available (e.g. because they are not disturbed by wind noise), the processing circuitry 220 may only record or may only enable recording in stereo and only if the two microphones have suitable spatial diversity i.e. one is located to the left of the device 250 and one to the right 250 from a device center axis.

If there are only three microphones available (e.g. because they are not disturbed by wind noise), the processing circuitry 220 may only record or may only enable recording in spatial audio and only if the microphones have suitable spatial diversity.

If beamforming (reception diversity with phase offset) is used to focus captured sound for example to the direction of a speaker then the selected beamforming algorithm is adjusted according to the number and locations of microphones available (e.g. because they are not disturbed by wind noise).

If it is desired to select a closest microphone, it may only be selected from the microphones available ((e.g. because they are not disturbed by wind noise). The selected microphone may change with wind conditions. The closest microphone may be known by its location in the device 250 e.g. in a mobile phone the microphone that is closest to the end of the device where users typically has their mouth when speaking. Alternatively, the closest microphone may be selected by choosing the microphone that has largest signal (or best signal to noise ratio) at speech frequencies (400 Hz-4 kHz).

Spatial audio signals may be captured using microphone arrays. The spatial order depends on the number of microphones available ((e.g. because they are not disturbed by wind noise). A spatial audio system could switch to using a lower order if some of the microphones are or become not available because of wind noise. An example of spatial audio is Ambisonics which is a full-sphere surround sound technique.

Figure 5:
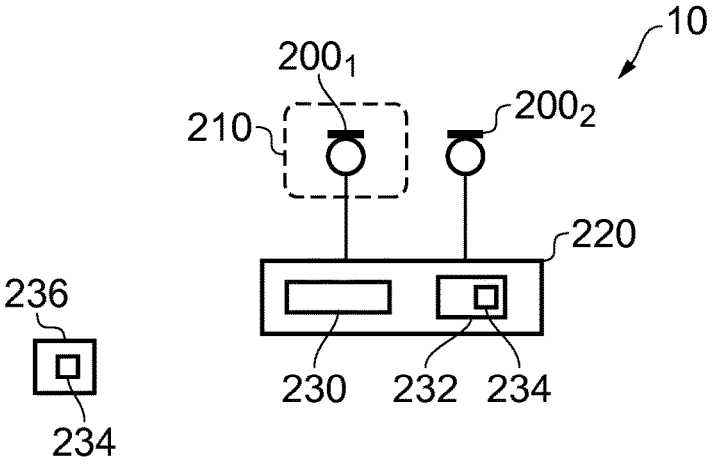
FIG. 5 illustrates an example of the apparatus where the processing circuitry is provided by a controller.

FIG. 5 illustrates an example of the apparatus 10, where the processing circuitry 220 is provided by a controller.

Implementation of a controller 220 may be as controller circuitry. The controller 220 may be implemented in hardware alone, have certain aspects in software including firmware alone or can be a combination of hardware and software (including firmware).

As illustrated in FIG. 5 the controller 220 may be implemented using instructions that enable hardware functionality, for example, by using executable instructions of a computer program 234 in a general-purpose or special-purpose processor 230 that may be stored on a computer readable storage medium (disk, memory etc) to be executed by such a processor 230.

The processor 230 is configured to read from and write to the memory 232. The processor 230 may also comprise an output interface via which data and/or commands are output by the processor 230 and an input interface via which data and/or commands are input to the processor 230.

The memory 232 stores a computer program 234 comprising computer program instructions (computer program code) that controls the operation of the apparatus 10 when loaded into the processor 230. The computer program instructions, of the computer program 234, provide the logic and routines that enables the apparatus to perform the methods illustrated in FIGS. 1 and 3 or discussed herein. The processor 230 by reading the memory 232 is able to load and execute the computer program 234.

The controller 220 therefore comprises:

at least one processor 230; and at least one memory 232 including computer program code the at least one memory 232 and the computer program code configured to, with the at least one processor 230, cause the apparatus 10 at least to perform:

processing a first microphone signal received from a first microphone having a first frequency response characteristic at frequencies associated with wind noise and a second microphone signal received from a second microphone having a second frequency response characteristic at frequencies associated with wind noise, wherein the first frequency response provides less gain than the second frequency response over the range of frequencies associated with wind noise, to detect the presence of wind noise.

The computer program 234 may arrive at the apparatus 10 via any suitable delivery mechanism 236. The delivery mechanism 236 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 234. The delivery mechanism 236 may be a signal configured to reliably transfer the computer program 234. The apparatus 10 may propagate or transmit the computer program 234 as a computer data signal.

Although the memory 232 is illustrated as a single component/circuitry it may be implemented as one or more separate components/circuitry some or all of which may be integrated/removable and/or may provide permanent/semi-permanent/dynamic/cached storage.

Although the processor 230 is illustrated as a single component/circuitry it may be implemented as one or more separate components/circuitry some or all of which may be integrated/removable. The processor 230 may be a single core or multi-core processor.

Figure 6:
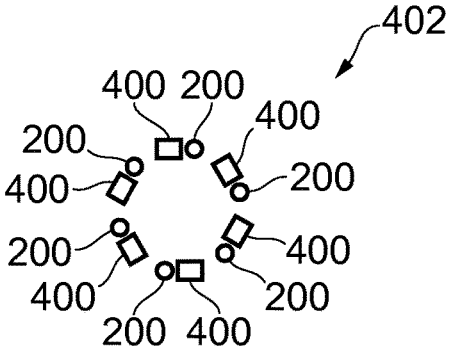
FIG. 6 illustrates an example of a media capture system that captures images using multiple cameras with different points of view and captures spatial audio using microphones.

FIG. 6 illustrates an example of a media capture system 402 that captures images using multiple cameras 400 with different points of view and captures audio using microphones 200.

In this example, the fields of view of the cameras 400 overlap to create a large combined field of view for the system. The (still or video) images captured by the cameras 400 may be stitched together to create a panoramic image with a wide field of view. In the example illustrated, the combined field of view of 360° in a horizontal plane. In some examples it may also have simultaneously a large field of view in the vertical plane. A vertical field of view of 180° combined with a horizontal field of view of 360° provides for image capture of the whole of the space surrounding the system 402.

It is also desirable to capture not only the visual scene using the cameras 400 but to also simultaneously capture the audio scene using microphones 200. The microphones 200 may be arranged to enable spatial audio, in which a recorded sound source can be rendered at a particular position to a user. This may be used to render a spatial audio sound scene that corresponds to a portion of the panoramic image displayed to a user.

This may be particularly useful in mediated reality systems and particularly virtual reality systems where it is desirable to provide a realistic immersive experience. The user may for example control the perspective within the mediated reality by changing their head orientation or gaze direction. The change in head orientation or gaze direction changes the point of view which changes the displayed portion of the panoramic image. It is desirable to have a corresponding change in spatial audio so that the sound scene rotates with the change in user point of view.

In the example of FIG. 6, each camera has an associated one or more microphones 200. However, in other implementations at least some of the microphones 200 may alternatively or additionally be moving microphones such as up-close (Lavalier microphones) or boom microphones, for example.

Any one (or more) of the microphones 200 described in relation to FIG. 6 may operate as the first microphone $\mathbf{200}_1$. Any one (or more) of the other microphones 200 described in relation to FIG. 6 may operate as the second microphone $\mathbf{200}_2$.

The apparatus 10, including electronic device 250 may be an apparatus or device that comprises multiple microphones 200, such as multimedia capture device: mobile phone, computer tablet, camera, Virtual Reality (VR) camera References to 'computer-readable storage medium', 'computer program product', 'tangibly embodied computer program' etc. or a 'controller', 'computer', 'processor', 'processing circuitry', 'processor means' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks illustrated in the figures may represent steps in a method and/or sections of code in the computer program 234. The illustration of a particular order to the blocks does not necessarily imply that there is a required or preferred order for the blocks and the order and arrangement of the block may be varied. Furthermore, it may be possible for some blocks to be omitted.

Where elements are illustrated in the figures as interconnected this means that they are operationally coupled. and any number or combination of intervening elements can exist (including no intervening elements).

Where a structural feature has been described, it may be replaced by means for performing one or more of the functions of the structural feature whether that function or those functions are explicitly or implicitly described.

The apparatus 10 comprises: first audio transducer means having a first frequency response characteristic at frequencies associated with wind noise; second audio transducer means having a second frequency response characteristic at frequencies associated with wind noise, wherein the first frequency response provides less gain than the second frequency response over the range of frequencies associated with wind noise; and processing means for processing a first microphone signal from the first microphone and a second microphone signal from the second microphone to detect the presence of wind noise.

As used here 'module' refers to a unit or apparatus that excludes certain parts/components that would be added by an end manufacturer or a user. The processing circuitry 220 may be a module.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one" or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method comprising:

receiving a first microphone signal from a first microphone having a first frequency response characteristic at frequencies associated with wind noise;

receiving a second microphone signal from a second microphone having a second frequency response characteristic at the frequencies associated with the wind noise, the second frequency response characteristic at the frequencies associated with wind noise being different from the first frequency response characteristic at the frequencies associated with wind noise due to an introduced difference in mechanical design between the first microphone and the second microphone;

determining a difference between the first frequency response characteristic and the second frequency response characteristic; and processing the first microphone signal and the second microphone signal by comparing the first microphone signal characteristic to the second microphone signal characteristic, at frequencies associated with wind noise, to detect presence of the wind noise.

2. The method as claimed in claim 1, wherein the difference between the first frequency response characteristic and the second frequency response characteristic results from a relative attenuation at the frequencies associated with the wind noise wherein the first frequency response characteristic has less gain than the second frequency response characteristic.

3. The method as claimed in claim 2, wherein the first frequency response characteristic has less gain than the second frequency response characteristic when the wind noise is greater than 6 dB.

4. The method as claimed in claim 1, wherein the first microphone comprises a cover having multiple apertures.

5. The method as claimed in claim 4, wherein the first microphone has a tuned first frequency response characteristic at the frequencies associated with the wind noise by controlling one or more of:

diameter of each aperture;

pitch between apertures;

depth of each aperture;

number of apertures; and area of coverage of apertures.

6. The method as claimed in claim 4, further comprising as least one of:

wherein the multiple apertures have a hydrophobic or oleophobic surface treatment; and wherein the cover defining the multiple apertures has a surface treated to increase surface roughness.

7. The method as claimed in claim 1, wherein the first microphone and the second microphone are microphones of a spatial audio system associated with a wide field of view camera system.

8. The method as claimed in claim 1, wherein the first microphone and the second microphone are microphones integral to an electronic device.

9. An apparatus comprising:

at least one processor; and at least one memory including computer program code, the at least one memory and the computer program code configured, with the at least one processor, to cause the apparatus at least to:

receive a first microphone signal from a first microphone having a first frequency response characteristic at frequencies associated with wind noise;

receive a second microphone signal from a second microphone having a second frequency response characteristic at the frequencies associated with the wind noise, the second frequency response characteristic at the frequencies associated with wind noise being different from the first frequency response characteristic at the frequencies associated with wind noise based on an introduced difference in mechanical design between the first microphone and the second microphone;

determine a difference between the first frequency response characteristic and the second frequency response characteristic; and process the first microphone signal and the second microphone signal by comparing the first microphone signal characteristic to the second microphone signal characteristic, at frequencies associated with wind noise, to detect presence of the wind noise.

10. The apparatus as claimed in claim 9, wherein the first frequency response characteristic provides less gain than the second frequency response characteristic over a range of frequencies associated with the wind noise.

11. The apparatus as claimed in claim 9, wherein the at least one memory and the computer program code are further configured, with the at least one processor, to compare the first microphone signal with a reference and the second microphone signal with the reference to detect the presence of the wind noise.

12. The apparatus as claimed in claim 9, wherein the at least one memory and the computer program code are further configured, with the at least one processor, to compare energy of the first microphone signal and energy of the second microphone signal to detect the presence of the wind noise.

13. The apparatus as claimed in claim 9, wherein the at least one memory and the computer program code are further configured, with the at least one processor, to compare the first microphone signal and the second microphone signal to detect the presence of wind noise, wherein at least one of the first microphone signal and the second microphone signal is normalised before comparison to enable the comparison.

14. The apparatus as claimed in claim 13, wherein the normalised at least one of the first microphone signal and second microphone signal comprises adjusting the first microphone signal at a range of frequencies and/or the second microphone signal at the range of frequencies in dependence upon a comparison between the first microphone signal and the second microphone signal at a higher range of frequencies not associated with the wind noise.

15. The apparatus as claimed in claim 9, wherein, when wind noise is detected, the at least one memory and the computer program code are further configured, with the at least one processor, to at least one of:

select at least one of the first microphone signal and the second microphone signal for suppression of wind noise; and select at least one of the first microphone signal and the second microphone signal for use.

16. The apparatus as claimed in claim 15, wherein the apparatus is caused to select at least one of the first and second microphone signals for use based on a lower threshold for strength of the wind noise and wherein the apparatus is caused to select at least one of the first and second microphone signals for suppression of the wind noise based on a higher threshold for strength of the wind noise.

17. The apparatus as claimed in claim 9, wherein, when wind noise is detected, the at least one memory and the computer program code are further configured, with the at least one processor, to control an output from one or more audio algorithms based on a number of microphones and/or a microphone at a location.

* * * * *